United States Patent [19]

Caprile et al.

[11] 3,944,132

[45] Mar. 16, 1976

[54] MULTI-POCKETED ENVELOPE

[76] Inventors: Robert C. Caprile; Marilyn E. Caprile, both of 197 N. Morton, Hoffman Estates, Ill. 60172

[22] Filed: Sept. 16, 1974

[21] Appl. No.: 506,221

[52] U.S. Cl. ..... 229/72
[51] Int. Cl.[2] ..... B65D 27/08
[58] Field of Search ..... 229/72, 56, 84

[56] References Cited

UNITED STATES PATENTS

| | | | |
|---|---|---|---|
| 1,324,692 | 12/1919 | Radics | 229/84 |
| 2,469,853 | 5/1949 | Terry | 229/72 |
| 2,607,524 | 8/1952 | Gerson | 229/72 |
| 3,570,752 | 3/1971 | Sczesniak | 229/72 X |

*Primary Examiner*—William Price
*Assistant Examiner*—Stephen P. Garbe
*Attorney, Agent, or Firm*—Donnie Rudd

[57] ABSTRACT

A multi-pocketed envelope is described. The envelope has side flaps which fold one underneath another with one projecting above the other to form two pockets, one above the other. The bottom then overlaps both side flaps sealing them to the base and forming a third pocket in line with the first two formed pockets. The top flap of the envelope folds over to cover the two pockets.

2 Claims, 6 Drawing Figures

FIG. 1
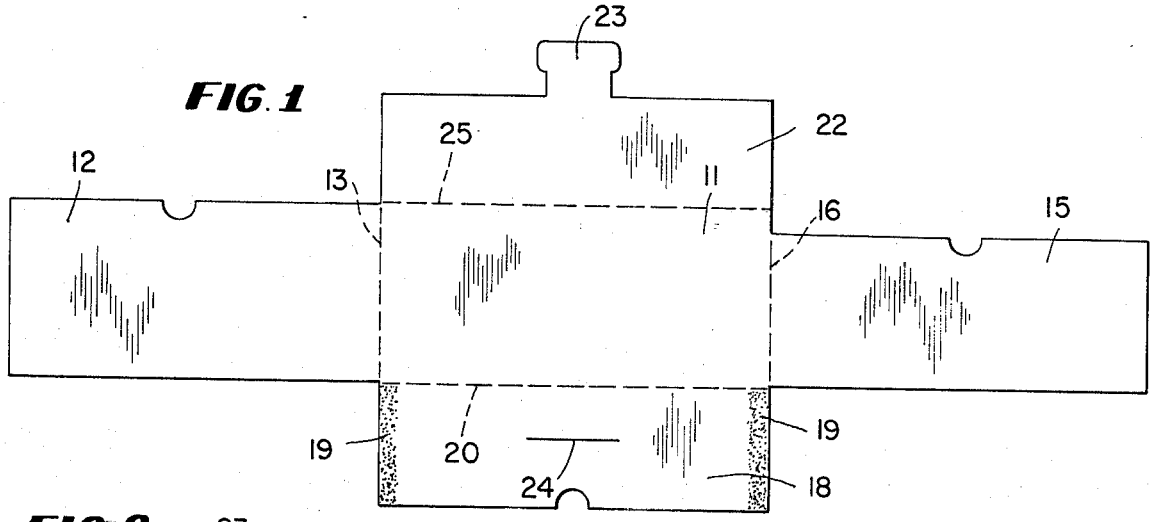
FIG. 2
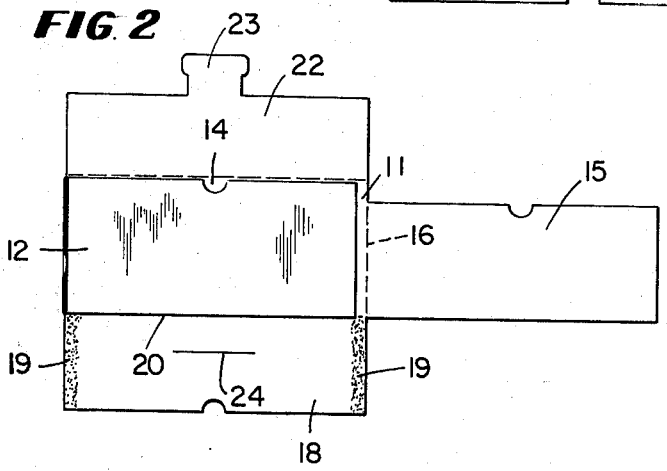
FIG. 3
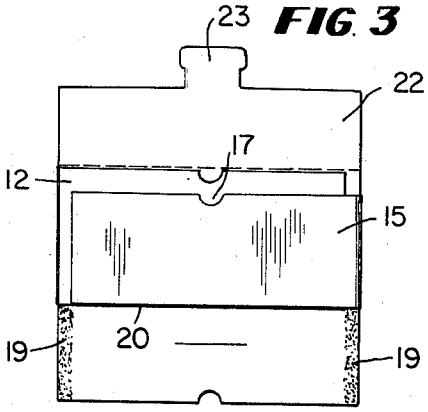
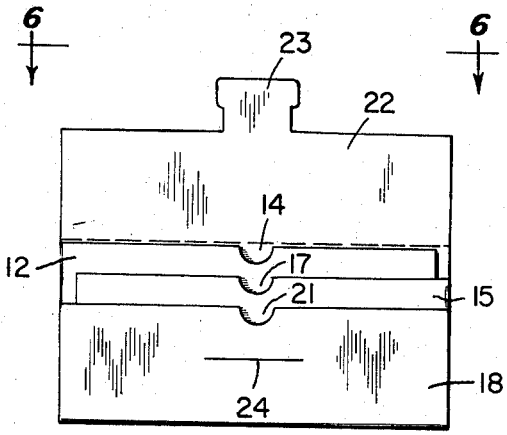
FIG. 4
FIG. 5
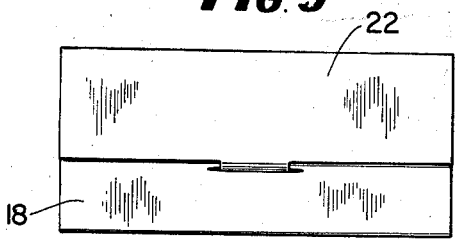
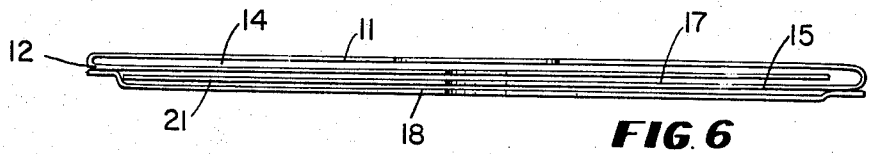
FIG. 6

MULTI-POCKETED ENVELOPE

BACKGROUND OF THE INVENTION

1. Field of the Invention

This invention relates to a multi-pocketed envelope which may be used for various functions such as containing a sales contract, a series of smaller payment envelopes and a payment coupon book.

2. Description of the Prior Art

Many multi-pocketed envelopes have previously been formed. None of these envelopes, however, contain three pockets all lined up in order to hold a sales contract, a sales payment book, and envelopes to make the payment in. It is readily desirable to have such an envelope in order to keep all features of a sales agreement together. For instance, U.S. Pat. No. 3,482,764 shows two pockets in an envelope but does not have the third feature with ready access thereto. U.S. Pat. No. 2,469,853 likewise shows a two-pocketed envelope. U.S. Pat. No. 3,790,068 shows a multi-pocketed envelope but with the layering such that it fits in a machine and not such as to have the entire content of the package within one subdivided chamber. U.S. Pat. No. 3,266,712 shows a multi-pocketed envelope for mailing but does not show one capable having all of the constituents herein in one divided chamber. U.S. Pat. No. 837,228 shows a multi-pocketed envelope but the pockets all open at the same level thereby not giving ready access to the multi-pockets. U.S. Pat. No. 1,683,584 shows a multi-pocketed envelope but not of the type that is utilized herein for providing the chambers and one which would close to contain all of the chambers. And, U.S. Pat. No. 2,749,021 shows a single-pocketed envelope for a similar use but does not have the necessary features as disclosed herein. While relatively simple, this invention provides a multi-pocketed with ready access to each chamber and which may be utilized in the heretofore described manner.

SUMMARY OF THE INVENTION

It is an object of this invention to provide a multi-pocketed envelope which may provide for ready access in a single subdivided chamber of a sales contract or the like, a sales payment book, and a multiplicity of smaller envelopes.

The object of this invention is accomplished by a multi-pocketed envelope, said envelope comprising a back panel having two side flaps, a bottom flap and a top flap, said side flaps folding at the side edges of the back panel and extending substantially across the back panel and forming two separate and distinct pockets with one of said side flaps being taller than the other side flap to form openings to the pockets one above the other, said bottom flap folding at the bottom of the back panel and extending upward to form a bottom pocket separate and distinct from the pocket formed by the side flaps and said bottom pocket opening below the openings of the pockets formed by the side flaps, said bottom flap being adhesively secured at its side portions to the side flaps to form the pockets, and said top flap folding over the pockets to enclose them and secure them shut.

Preferably the objects of this invention are accomplished by a multi-pocketed envelope wherein the top flap secures the pocket shut by having a tongue thereon which engages a slot in the bottom flap.

More particularly the envelope of this invention is a back panel which has two side panels. The side panels fold one over the other to form separate and distinct pockets. One of the side flaps must be taller than the other side flap in order to form an opening of its pocket above the opening of the other. The bottom flap which folds upward then secures both of the other flaps to form chambers on them and forms a third opening for holding some type of material. The top then folds over and may be secured shut by having a tongue thereon which engages a slot in the bottom flap.

BRIEF DESCRIPTION OF THE DRAWINGS

This invention may be more fully described but is not limited by the following drawings in which:

FIG. 1 shows the blank envelope of this invention;

FIG. 2 shows the first flap folded thereover;

FIG. 3 shows the second side flap folded thereover;

FIG. 4 shows the bottom flap folded up to complete the three pockets in the envelope;

FIG. 5 shows the closed envelope with the top flap secured into the bottom flap; and FIG. 6 shows the top view of the envelope as taken along lines 6—6 of FIG. 4.

In the drawings I have used the numeral 11 to refer to the back panel of the envelope. The first side panel 12 is folded along weakened line 13 to provide opening and chamber 14. A second side flap 15 is folded along weakened line 16 to form a second pocket or opening 17 which may also hold other material. The bottom flap 18 having glue lines 19 thereon is secured to the other panels by folding along weakened line 20, thus forming a third pocket or opening 21. The top flap 22 having a tongue 23 thereon is then folded along weakened line 25 to secure the closing of the openings or pockets and may be secured to the bottom flap 18 by tongue 23 being engaged in slot 24. The envelope may then be utilized to carry three diverse sets of material such as a sales contract in one pocket, a sales coupon book in a second pocket, and smaller envelopes in the third pocket.

DESCRIPTION OF THE PREFERRED EMBODIMENTS

The drawings of this invention constitute the preferred embodiments of this invention.

We have discovered a new and novel envelope and although it is simple it is highly functional for use in the savings and loan industry and for banking purposes. It makes possible the containment of the complete sales package for installment sales purchases. While simple, it is highly desirable and useful in this type of function.

Having fully described this new and unique invention, we claim:

1. A three pocket envelope, said envelope comprising a back panel having two side flaps hingedly connected to said back panel along its side edges, one of said flaps having a height greater than the height of the other said side flap, a bottom flap hingedly connected to said back panel along its bottom edge, said flap having a height less than the height of the shorter of said side flaps, and a top flap, hingedly connected to said back panel along its top edge said side flaps extending substantially across the back panel and terminating within close proximity of the side edges of the back panel and forming two separate and distinct pockets with one of said side flaps being taller than the other side flap to form openings to the pockets one above the other, said one of said side flaps directly overlying said back panel, said bottom flap extending upward from the bottom edge of said back panel to form a bottom pocket that is separate and distinct from the pocket formed by the side flaps, said bottom pocket opening below the openings of the pockets formed by the side flaps, said bottom flap being adhesively secured at its side portions to the side flaps said top flap being capable of folding over the pockets to enclose them and secure them shut.

2. A multi-pocketed envelope as in claim 1 wherein the top flap secures the pockets shut by having a tongue thereon which engages a slot in the bottom flap.

* * * * *